United States Patent [19]

Roberts

[11] 4,085,470

[45] Apr. 25, 1978

[54] VENTILATED TOILET DEVICE

[76] Inventor: George Roberts, 2219 Edward Street, Regina, Canada

[21] Appl. No.: 759,421

[22] Filed: Jan. 14, 1977

[51] Int. Cl.[2] ..... E03D 9/04; A47K 13/00

[52] U.S. Cl. ..... 4/213; 4/217

[58] Field of Search ..... 4/217, 213, 216, 72

[56] References Cited

U.S. PATENT DOCUMENTS

| | | | |
|---|---|---|---|
| 2,146,982 | 2/1939 | Perreault | 4/217 |
| 2,172,506 | 9/1939 | Gerger | 4/217 |
| 2,988,756 | 6/1961 | Hartley | 4/213 |
| 3,357,029 | 12/1967 | Schulz | 4/217 |
| 3,491,382 | 1/1970 | Poister | 4/217 |
| 3,564,624 | 2/1971 | Paley | 4/217 |
| 3,740,772 | 6/1973 | Paley | 4/217 |
| 3,953,901 | 5/1976 | Poister et al. | 4/217 |
| 3,999,225 | 12/1976 | Ables | 4/217 |

*Primary Examiner*—Henry K. Artis
*Attorney, Agent, or Firm*—Stanley G. Ade

[57] ABSTRACT

Usual ventilating toilet devices require a relatively expensive vent system built into the seat unit or an attachment to the seat unit which has to be custom-designed for specific toilet bowl constructions. This means that they are not universal in attachment and are therefore relatively expensive. The present device is a horseshoe-shaped pad with air intake grooves on the underside and which can be engaged upon the bowl of the toilet between the bowl and the seat. A suction housing at the rear includes a sliding drawer at the front which can be adjusted to align with the rear curvature of the bowl and which can control the degree of suction to the bowl. The outlet on the side of the housing can readily be fitted upon either side depending upon installation requirements. The side not used is closed off with a sliding drawer or panel which can be used for access for cleaning, for insertion of deodorant material or the like, and to further control the degree of suction within the toilet bowl.

6 Claims, 7 Drawing Figures

VENTILATED TOILET DEVICE

BACKGROUND OF THE INVENTION

This invention relates to new and useful improvements in ventilating devices for toilet bowls. Many attempts have been made to produce an economical, easily installed device which can be fitted to the majority of toilet bowls without extensive alterations.

The majority of these are not universal inasmuch as they have to be custom-designed for individual makes of toilet bowls and often require a specifically designed seat construction which is expensive to manufacture.

SUMMARY OF THE INVENTION

The present invention overcomes these disadvantages by providing a relatively thin cross sectioned pad which can be engaged between the seat and the top of the bowl and which engages upon the planar portion of the bowl and which can be bolted to the bowl by means of the usual bolts holding the seat assembly to the bowl.

The principal object and essence of the invention is therefore to provide a device of the character herewithin described which can readily be secured to existing toilet bowls without alteration thereto.

Another object of the invention is to provide a device of the character herewithin described in which the discharge of the suction housing can readily be fitted to either side once again depending upon the design requirements.

A still further object of the invention is to provide a device of the character herewithin described which includes means to control the degree of suction reaching the interior of the bowl.

A further object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 2:
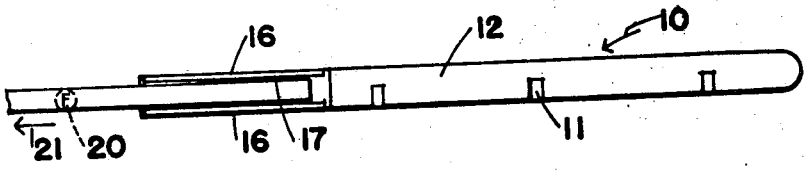
FIG. 2 is a side elevation of FIG. 1.
Figure 1:
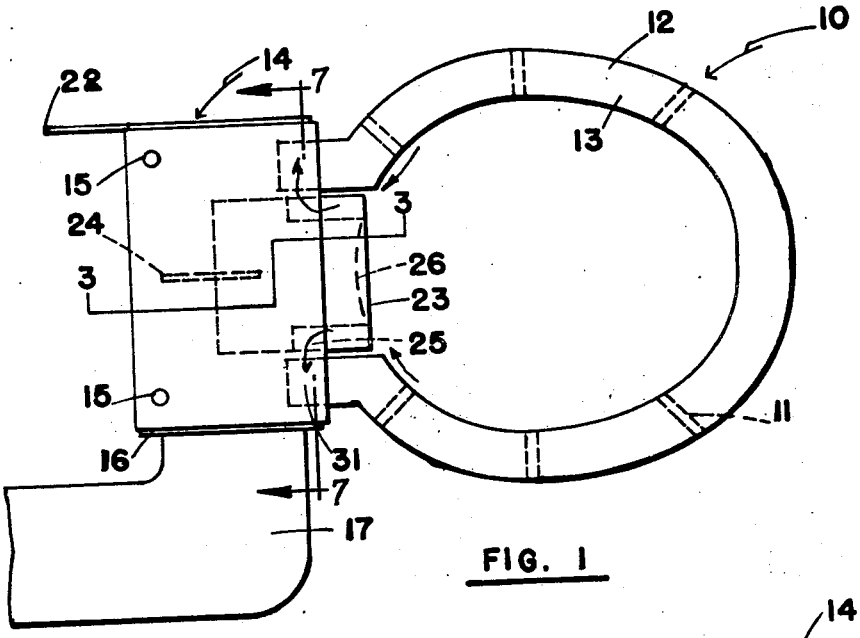
FIG. 1 is a top plan view of the device.
Figure 3:
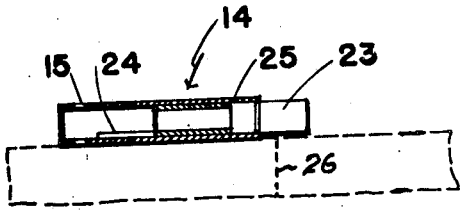
FIG. 3 is a fragmentary cross sectional view along the lines 3—3 of FIG. 1.

Proceeding therefore to describe the invention in detail, reference character 10 illustrates a substantially horseshoe shaped element which may be made of relatively resilient plastic and has a configuration, when viewed in plan, similar to the configuration of the upper side of a conventional toilet bowl.

Air transfer means are provided and take the form of radially extending slots 11 formed upon the underside of the pad 10 and extending from the outer perimeter 12 to the inner perimeter 13 so that when the pad is resting upon the upper edge of a toilet bowl, air communication is provided through the slots 11. By the same token, if the toilet floods for any reason, water may escape through these slots.

A suction housing collectively designated 14 is provided and consists of a substantially rectangular box when viewed in plan, preferably made of plastic and designed to rest upon the planar portion at the rear of a conventional toilet bowl (not illustrated). In this connection apertures 15 are provided through the housing and through which the bolts normally holding the seat component to the bowl, may extend thus fixing the device between the seat and the planar portion of the bowl.

This housing is hollow and is provided with open ends, each open end having spaced and parallel slide flanges 16 formed thereon. The air discharge portion 17 is provided with a rectangular end 18, the upper and lower edges 19 of which are adapted to engage within the slides 16 so that this portion can be slid into position on either side of the housing depending upon installation requirements. This portion 17 extends by means of flexible conduit, to a fan component shown schematically by reference character 20 which is adapted to move air from the housing and through the conduit in the direction of arrow 21 thus causing an area of negative pressure within the housing 14.

A sliding pate 22 is provided and engages the slide flanges 16 on the housing opposite to the side supporting the discharge portion 17 and this slide plate 22 can either be fully closed thus closing off the open end of the housing or can be opened slightly to control the degree of suction within the housing. Furthermore, this sliding plate provides access to the interior of the housing for cleaning purposes, or for the placement therein of a deodorant block or similar material.

A drawer component 23 engages within a substantially rectangular opening within the front of the suction housing 14 and this drawer component mounts on a central slide 24 in a conventional manner so that it can be moved inwardly and outwardly relative to the housing. The two front corner portions 25 of the drawer are open and provide communication between the interior of the toilet bowl and the interior of the suction housing the degree of communication depending upon the position of the drawer 23. The further outwardly the drawer is moved, the greater the degree of communication and vice-versa. This drawer not only controls the degree of communication hereinabove described, but also can be adjusted to cover the rear curvature 26 of the toilet bowl thus enabling the device to be used on toilet bowls of different dimensions. The drawer is moved forwardly sufficient to provide the necessary degree of communication between the interior of the bowl and the interior of the suction housing and any further control is by means of the position of plate 22.

Figure 6:
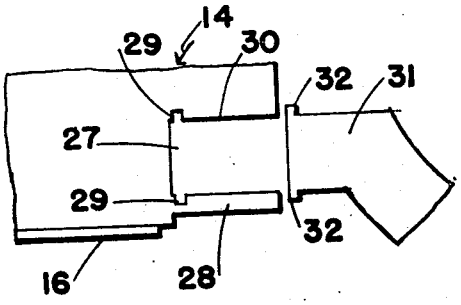
FIG. 6 is a fragmentary top plan view of one corner of the suction housing.
Figure 5:
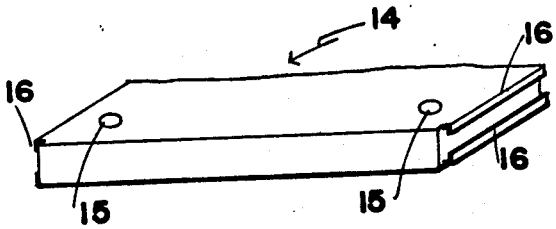
FIG. 5 is a fragmentary isometric view of the rear side of the suction housing.
Figure 4:
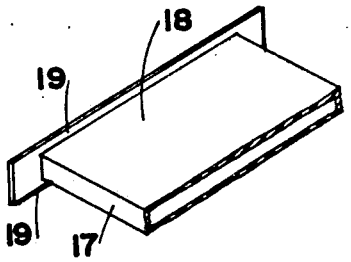
FIG. 4 is a fragmentary isometric view of the attaching end of the discharge portion.
Figure 7:
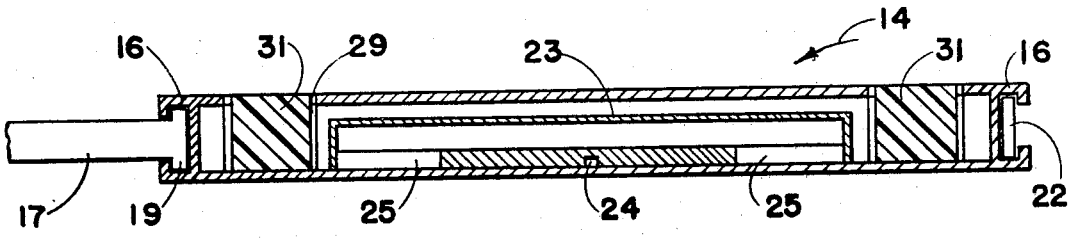
FIG. 7 is an enlarged fragmentary cross sectional view substantially along the line 7—7 of FIG. 1.

The horseshoe-shaped component 10 is preferably detachably connected to the suction housing 14 and details of one form of connection are shown in FIG. 6. The corner portions 27 of the housing are cut away as shown and a flange 28 extends as clearly illustrated. Grooves 29 are provided within the wall 30 of the corner portion and within the flange 28, adjacent the inner ends of the wall 30 and the flange 28. The ends 31 of the horseshoe-shaped component 10 are provided with extending vertically situated beads 32 which slide downwardly into the grooves 29 thus detachably holding the component 10 to the suction housing 14.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A toilet ventilating device for toilet bowls which include an upper open side and a rear planar portion behind said upper open side; comprising in combination a substantially horseshoe-shaped element engageable upon said upper open side of said bowl, a suction housing secured to the ends of said elements and engageable upon said rear planar portion; conduit means connected to said suction housing operatively connected to a source of negative air pressure, and air intake means in said suction housing connecting to the interior of said bowl when said device is in position upon said bowl, means to control the degree of communication between the interior of the bowl and the interior of the suction housing via said air intake means in said suction housing, said means to control the degree of communication including a drawer component slidably engaging within the front of said suction housing and extending into said suction housing, and means in said drawer component communicating between the interior of said suction housing and said bowl, the degree of communication depending upon the position of said drawer component with said suction housing.

2. The device according to claim 1 in which said conduit means includes means on each side of said housing for selectively attaching said conduit means to one side or the other, and sliding panel means engaging the other side of said housing to which said conduit means is attached.

3. The device according to claim 1 in which includes air transfer means on the underside of said element said air transfer means including a plurality of radially extending slots formed on the underside of said element.

4. The device according to claim 2 in which includes air transfer means on the underside of said element said air transfer means including a plurality of radially extending slots formed on the underside of said element.

5. The device according to claim 2 in which said sliding panel means can be moved relative to said housing whereby air intake through said other side may be varied.

6. The device according to claim 4 in which said sliding panel means can be moved relative to said housing whereby air intake through said other side may be varied.

* * * * *